US008622479B2

(12) United States Patent
Hargrave et al.

(10) Patent No.: US 8,622,479 B2
(45) Date of Patent: Jan. 7, 2014

(54) MINING METHODS AND APPARATUS

(75) Inventors: Chad Owen Hargrave, Gaythorne (AU); David Charles Reid, Karana Downs (AU); David William Hainsworth, Westlake (AU); Jonathan Carey Ralston, Gaythorne (AU); Michael Shawn Kelly, Pullenvale (AU); Ronald John McPhee, The Gap (AU)

(73) Assignee: Commonwealth Scientific and Industrial Research Organisation, Campbell, ACT (AU)

( * ) Notice: Subject to any disclaimer, the term of this patent is extended or adjusted under 35 U.S.C. 154(b) by 862 days.

(21) Appl. No.: 11/913,838

(22) PCT Filed: May 11, 2005 (Under 37 CFR 1.47)

(86) PCT No.: PCT/AU2005/000674
§ 371 (c)(1), (2), (4) Date: Nov. 12, 2008

(87) PCT Pub. No.: WO2006/119534
PCT Pub. Date: Nov. 16, 2006

(65) Prior Publication Data
US 2009/0212216 A1 Aug. 27, 2009

(51) Int. Cl.
*E21C 35/08* (2006.01)

(52) U.S. Cl.
USPC ..... 299/1.1; 299/14; 299/95; 250/332; 239/4; 239/102

(58) Field of Classification Search
USPC ..... 299/1.1, 14, 95, 1.7, 1.6; 250/332; 239/4, 102
See application file for complete search history.

(56) References Cited

U.S. PATENT DOCUMENTS

| | | | | |
|---|---|---|---|---|
| 4,072,349 | A | 2/1978 | Hartley | |
| 4,155,594 | A | 5/1979 | Hartley et al. | |
| 4,181,360 | A | 1/1980 | Wilson | |
| 4,715,657 | A * | 12/1987 | Sato et al. | 299/1.6 |
| 6,666,521 | B1 | 12/2003 | Pease et al. | |

FOREIGN PATENT DOCUMENTS

| | | |
|---|---|---|
| CN | 1497127 | 5/2004 |
| GB | 2 092 641 | 8/1982 |
| JP | 63-139285 | 6/1988 |

OTHER PUBLICATIONS

Hartman, Howard L., "SME Mining Engineering Handbook", Society for Mining, Metallurgy, and Exploration, Inc., 2nd Edition, vol. 2, p. 1911, 1992.

* cited by examiner

*Primary Examiner* — Yong-Suk (Philip) Ro
(74) *Attorney, Agent, or Firm* — Merchant & Gould P.C.

(57) ABSTRACT

A method and apparatus for horizon control in a mining operation where fresh product 3 is cut from a seam 1. The cutting exposes a fresh cut product face 25. The fresh cut product face 25 is observed at a position immediately adjacent a cutter 11. Any temperature contrast regions from an IR observation between an upper limit of observation and a lower limit of observation are noted. At least one height co-ordinate position of a temperature contrast region 33 is determined and an output signal provided of the determined height co-ordinate position so that the output signal can be used as a horizon datum for horizontal control.

21 Claims, 9 Drawing Sheets

MINING METHODS AND APPARATUS

FIELD OF THE INVENTION

This invention relates to mining methods and apparatus and relates particularly but not exclusively to mining methods and apparatus suitable for longwall mining applications. The invention has application in other mining applications and is not to be limited to longwall mining exclusively.

BACKGROUND ART

Hitherto, it has been known to provide mining methods and apparatus to control mining of product from a seam of product in the mine. One known longwall mining method involves observing infrared (IR) radiation from a fresh cut product face at a position immediately adjacent the cutter at the region where a vertical wall of cut intersects with either an upper or lower wall of cut. Such method determines either an upper or lower limit of the seam of the product in the mine by noting if there is an IR temperature increase at the intersection of the vertical cut wall and either the horizontal cut floor or horizontal cut roof. An IR temperature increase occurs when a cutter cuts into strata in the roof or floor immediately above or below the seam of the product. This is because the strata is usually harder than the production in the seam and therefore the strata heats more during the cutting process than the product. Thus, by noting an IR temperature increase at this region, one can determine the upper and/or lower limits of the seam of the product in the mine. Signals can be generated defining the upper limit or lower limit of the seam so that the mining machine can be controlled to cause the cutter to not cut into the overlying or underlying strata.

Such methods and apparatus are useful, however, such methods and apparatus do have their failings and it is possible for the overlying or underlying strata to be mined and cut with the product from time to time. This places undue loadings on the mining equipment, dilutes product content and gives rise to other production problems including an increase in dust within the mine which, in turn, affects personnel safety within the mine.

OBJECT AND STATEMENT OF THE INVENTION

There is a need for an improved method and apparatus.

According to one aspect of the invention there is provided a method of horizon control in a mining operation where mined product is cut from a mining face of a seam of the product, said method comprising, cutting product from the seam with a cutter that exposes a fresh cut product face visually observing the IR radiation from the fresh cut product face at a position immediately adjacent the cutter, Noting any temperature contrast regions from the IR observation between an upper limit of observation and a lower limit of observation, Determining at least one height co-ordinate position of at least one temperature contrast region, and generating an output signal of the determined height co-ordinate position so the generated output signal can be used as a horizon datum for horizon control.

According to another aspect of the invention there is provided a sensing apparatus for operating with mining machine horizon controlling apparatus, said sensing apparatus having an image acquisition section for receiving IR image signals of an observed position of a fresh cut mined product face immediately adjacent a mining machine cutter a signal processing component to process the acquired IR image signals to note for at least one temperature contrast region between an upper part of the image and a lower part of the image, a height position component to receive any noted temperature contrast region processed by the signal processing component and to calculate a height position of the at lest one noted temperature contrast region, and a signal output component to provide an output signal of the calculated height position for said mining machine horizon controlling apparatus.

According to another aspect of the invention there is provided a method of identifying thermally identifiable structure in a product mined from a mining face in a mine where a cutter cuts the product and exposes a fresh cut product face, said method comprising visually observing the IR radiation from the fresh cut product face immediately adjacent the cutter, noting at least one temperature contrast region from the IR observation and determining a thermally identifiable structure in the product mined by either;

1. the size magnitude of at least one temperature contrast region or, 2. contrast region above a temperature threshold.

According to another aspect of the invention there is provided an apparatus to identify thermally identifiable structure in a mined product when mining product from a mine, said apparatus having an image acquisition section for receiving IR image signals of an observed position of a freshly exposed cut product face immediately adjacent a mining machine cutter that cuts product from the mine, a signal processing component to process the acquired IR image signals to note at least one temperature contrast region, an image processing component to identify thermally identifiable structure of the mined product by either 1. noting the size magnitude of the at least one temperature contrast region, or 2. noting the magnitude of the at least one temperature contrast region above a temperature threshold, and an output component to provide an output indicating thermally identifiable structure in the mine product.

BRIEF DESCRIPTION OF THE DRAWINGS

In order that the invention can be more clearly ascertained examples of embodiments of the invention will now be described with reference to the accompanying drawings based on a longwall mining application. As stated previously, the invention is not to be limited to longwall mining applications and the description hereinafter is to be taken as an example. For other mining applications, the principles outlined herein can be utilised in a similar way.

In the drawings.

In the description that follows, a longwall mining application is discussed. As stated previously, the inventive concepts are not to be limited to longwall mining. The inventive concepts can be practised in other mining applications/techniques and the invention is to be considered to extend to those other mining applications/techniques as well.

Figure 1:
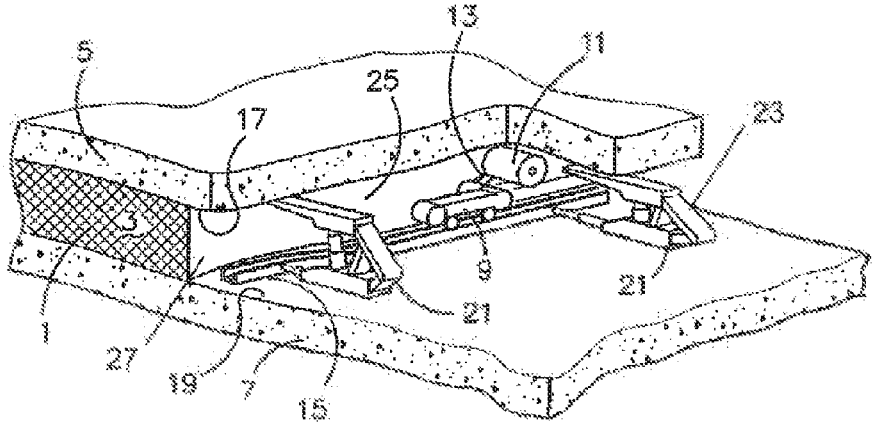
FIG. 1 is a diagrammatic perspective view of a longwall mining process deep within the earth.

FIG. 1 is a diagrammatic perspective view showing a seam 1 of product 3 in a mine. Typically, the product 3 is coal but it may be other material. Coal is usually deposited in the seam 1 in layers. The seam 1 is bounded by upper strata 5 and lower strata 7. The coal may be deposited in layers of different geological materials such as the coal itself, clay or ash or other material of varying thickness and hardness. This layering may appear as thin horizontal line-like bands in the seam 1 of the coal. These line-like bands are strongly linked to the profile of the seam 1. Because these line-like bands are strongly linked to the profile of the seam 1, we have realised that by noting one or more of these line-like bands we can provide a means for setting a datum for mining machine horizon control. Typically, the bands are not always clearly visible with the naked eye and some automated process is required to detect the one or more bands and to provide output signals that can be used by a mining machine conventional horizon control circuit for controlling the horizon position of the mining machine and the cutter carried thereby.

FIG. 1 shows a partly mined mine where a mining machine 9 carries a rotating cutter drum 11. The cutter drum 11 is carried on an arm 13 that can swing up and down relative to the mining machine 9. The mining machine 9 is carried on a rail means 15 that extends across the width of the seam 1 (or at least across width of the intended mining area of the seam 1). The mining machine 9 moves along the rail means 15 and the arm 13 is raised or lowered so the rotating cutter drum 11 cuts product 3 from the seam 1. In some instances, the mining machine 9 may have a second arm (not shown) and cutter drum 11 located at the other end of the mining machine 9. In this case one of the cutter drums 11 cuts product 3 from seam 1 up towards a roof 17 of the mine and the other cutter drum 11 cuts downwardly towards a floor 19 of the mine. Typically, the roof 17 is determined at the interface between the seam 1 and the upper strata 5. Similarly, the floor 19 is determined at the interface between the seam 1 and the lower strata 7. The overhanging roof 17 is supported by a plurality of chocks 21. Only two chocks 21 have been shown, but in practice, there are many chocks 21 spaced adjacent one another along the length of the rail means 15. The chocks 21 connect at their lower foot region with the rail means 15 and can be manipulated to push the rail means 15 forwardly towards the seam following passing of the mining machine 9. The chocks 21 can be further manipulated to then draw themselves as a whole towards the rail means 15 moving the upper supporting arms 23 close to the fresh cut product face 25 of the seam 1. The technique for moving the mining machine 9 and swinging the cutter drums 11 and the movement of the chocks 21 is considered known in the longwall mining arts per se and will not be detailed further herein.

Figure 2:
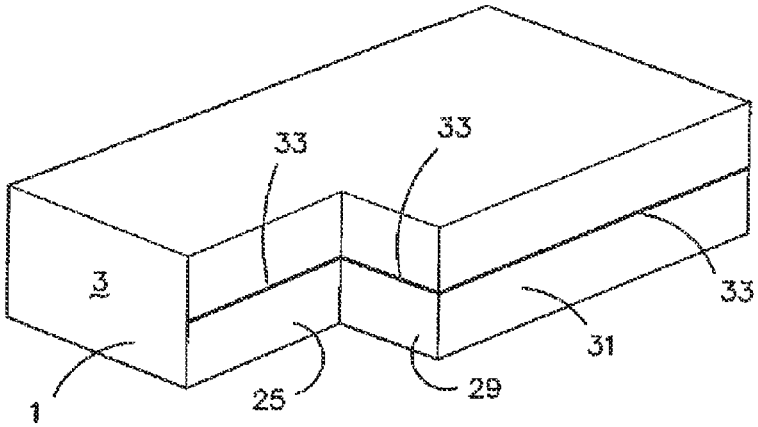
FIG. 2 is a schematic diagram similar to FIG. 1 showing a mined product seam exhibiting an IR contrast region, in the form of a band, at a fresh cut product face.

FIG. 2 is an exploded perspective view showing the seam 1 of the product 3 as shown in FIG. 1 without the upper strata 5, lower strata 7, mining machine 9 and chocks 21. Here, it is clearly shown that the mining machine cutter drum 11 has cut a fresh cut product face 25 which comprises an upright wall 27 that extends from side to side across the seam 1. It also comprises an upright end wall 29 that has a depth into the seam equal to the depth of the cutter drum 11. FIG. 2 also shows a previously cut product face 31 that extends parallel to the fresh cut product face 25. FIG. 2 also shows a single band or feature 33 that extends throughout the seam 1. In practice, there may be one or more bands or features 3, all approximately extending in planes parallel to one another. The bands or features 33 are generally planar but there are some falls and other contours present due to the nature of layering of the seam 1. Typically, the band or feature 33 is formed from a material deposit that is of greater hardness than that of the product 3 itself. In some cases, the band or feature 33 may be visibly discernible with the naked eye but it may also be non visible to the naked eye.

We have found that if the IR radiation emitted from the fresh cut product face 25 adjacent the cutter 11 is observed, then the band or feature 33 shows a higher IR radiation level than the level of the surrounding product 3. This is presumably because the cutter 3 heats the material of the band or feature 33 greater than that of the product 3 during the cutting/mining process. Accordingly, by observing the IR radiation from the fresh cut product face 25 at a position immediately adjacent the cutter 11, it is possible to note for any temperature contrast regions from the IR observation between an upper limit of observation and a lower limit of observation. In this way, if the upper limit is ideally just below the interface between the seam 1 and the upper strata 5 and/or the lower strata 7, then any noted contrast regions will be indicative of the presence of a band or feature 33. The band or feature 33 position can then be used for horizon controlling the mining machine 9. As the band or feature 33 is generally parallel to the upper or lower limit of the seam 1 with regard to the roof 17 or the floor 19, providing a datum based on at least one contrast region permits an ideal mechanism for horizon datum setting for mining machine 9 control.

In the example of the preferred embodiment a PAL long wavelength (8-14 micron) thermal IR video camera at 25 fps is used to provide a digital picture image of the fresh cut product face 25. It may also be possible to use a CCD video camera which is sensitive to short wavelength (1-3 micron) thermal IR radiation for visually observing the fresh cut product face 25. The image capture device may be appropriately chosen to suit the particular product being mined and the mining environment. When a video camera is used, analysis of the resulting digital picture image may be made at each frame or at selected frames say every $25^{th}$ frame. Alternatively, a thermal IR still camera may be utilised and images generated at predetermined time intervals consequent on the speed of movement of the mining machine 9 across the face of the seam 1 during the mining operation. In the present example, the imaging device is a digital thermal IR video camera that observes the fresh cut product face 25 that extends in a direction across the width of the mining of the seam 1 and every frame is analysed, as this increases sensitivity of the system to low thermal IR values compared to analysing at say every $25^{th}$ frame. In an alternative arrangement the fresh cut product face may be the upright end wall 29 representing the depth of cut of the cutter drum 11. This alternative is to be considered within the scope of the invention. Desirably, the camera views a region of interest in the fresh cut product face 25 in the immediate vicinity of the cutter drum 11. In this way, the residual IR radiation will be expected to be near a peak level and where the temperature will not have dissipated due to passage of time following the passing of the cutter drum 11.

The infrared sensitivity of a thermal infrared camera has particular advantage over standard visible-wavelength cameras in mining operations. In particular, long wavelength thermal infrared cameras are highly insensitive to occlusions caused by dust. Thermal IR cameras can also function in total darkness which further makes IR cameras of this type suitable for practical implementation. The field of view 34 encompassing the region of interest 35 of the camera is likely to show important features of interest that appear in the thermal domain that may not otherwise appear in the visible domain. A typical position for mounting of the camera is on the body of the mining machine 9 and oriented such that the camera has a viewable aspect at the region of interest of the cutter drum 11 and any surrounding seam 1 or strata 5,7 and so that it is protected from rough operational conditions of mining.

Figure 3:
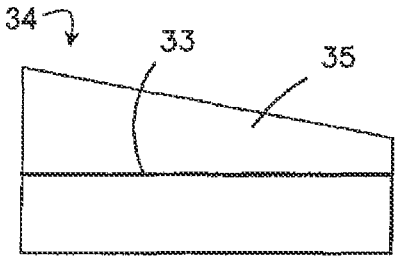
FIG. 3 is a diagrammatic view showing a field of view of an IR camera that observes a fresh cut product face at a position in the region of a cutter and between a lower limit of the seam and an upper limit of the seam.

FIG. 3 shows a field of view 34 encompassing the region of interest 35 of the digital video camera. In this case, the region of interest 35 is somewhat trapezoidal in shape. This is consequent on the angle of inclination of the camera relative to the fresh cut product face 25. The region of interest 35 is selected within the picture image 34 by selecting particular pixels to define the area of the region of interest. FIG. 3 shows a single band or feature 33 but other bands or features 33 may be present.

Figure 4:
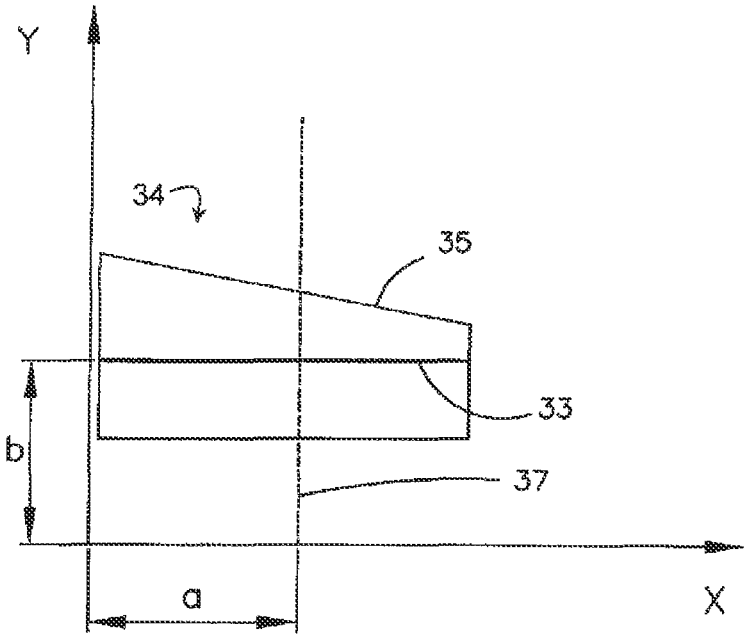
FIG. 4 is a diagram showing the field of view of the IR camera as shown in FIG. 3 but showing a datum position for noting temperature contrast regions.

FIG. 4 shows the setting of a viewing datum 37 at a distance "a" from a zero position on a horizontal axis "X". The datum position 37 extends in a vertical axis direction "Y" up and down the height of the field of view 35 of the IR radiation. FIG. 4 shows that the datum position 37 has a point of intersection with the band or feature 33 at a height "b" in the "Y" (vertical) direction. Thus, by determining a co-ordinate relating to the intersection of the datum position 37 with the band or feature 33, one can note the position of the band or feature 33 and use the co-ordinate position to horizon control the mining machine 9.

It should be appreciated that as the mining machine 9 moves across the seam 1 the field of view 34 will also move and the position of the one or more bands or features 33 will be tracked. Thus, as the seam 1 moves up or down, the band or feature 33 would be expected to move in unison, and continual control of the mining machine 9 can be achieved by noting the height of the intersection position of the datum position 37 with the band or feature 33. Thus, should the height position of the band or feature 33 change then there will be a corresponding change in the co-ordinate position of the intersection which can be used to provide a signal for controlling the mining machine 9.

Figure 5:
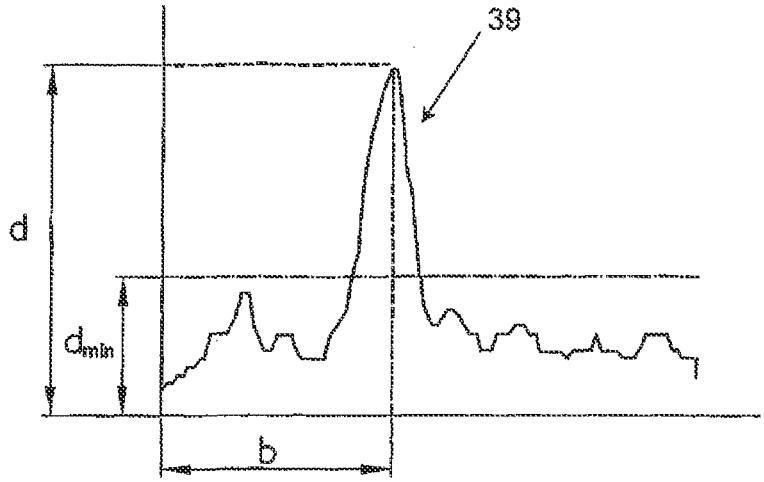
FIG. 5 is a graph showing image pixel grey scale intensity levels of pixels measured along the datum shown in FIG. 4.

Referring now to FIG. 5 there is shown a plot of IR pixel intensity value levels determined from the camera with respect to the background in the region of interest 35 in the field of view 34. In the example herein, the datum position 37 is defined by specific pixel locations in the digital picture image obtained from the digital video camera. FIG. 5 shows the grey scale pixel intensity value levels of the pixels along the datum position 9 extending in a direction up and down the height of viewing. The graph shows a peak in the pixel grey scale intensity values at a height distance "b" in FIG. 4. In FIG. 5, the height distance "b" is shown along the horizontal axis. Here, a localised peak 39 appears in the pixel grey scale intensity values at height "b". The magnitude of the localised peak 39 is shown by ordinate "d". FIG. 5 also shows that a threshold value having an ordinate "$d_{min}$" can be set. Thus, if the localised peak 39 exceeds the threshold value of $d_{min}$, this then represents a temperature contrast region relative to the surrounding background. This, in turn, represents the height positioning of a band or feature 33. Typically, $d_{min}$ is set to be just above the background threshold level of IR radiation emitted from the fresh cut product face 25 for the known composition of the product 3 such as coal. The threshold value represented by $d_{min}$ is necessary to cater for instances where the band or feature 33 is either not present or poorly discriminated from the background. If the largest value of "d" of the vertical line grey scale pixel intensity data is equal to or greater than a given minimum band detection threshold $d_{min}$, then the index "b" (along the horizontal axis) associated with the maximum value "d" is taken to be a valid location of the temperature contrast region (and the band or feature) in the image. If the value "d" is less than the threshold value $d_{min}$ then no height determination is calculated.

Any tracking of the band or feature 33 needs to take into account errors and observation noise associated with the detection and/or localisation processes. This is particularly important in cases where the band or feature 33 appears relatively faint in the IR image. In some cases, the intensity values may be so high with respect to the background that no special processing may be required. In the case where there may be a relatively faint IR localised peak 39, then a robust filter tracking feature may be implemented. A "Kalman" filter represents a particularly useful robust filter and is well known filter for signal processing.

A Kalman filter recursively generates parameter estimates using a state vector, system model, and observation model. For this 1D position-velocity tracking scenario, the state vector is given by a (2×1) vector $$x(t) = \begin{matrix} [h(t)] \\ [v(t)] \end{matrix}$$

which contains the true height h(t) and velocity v(t) of the band or feature 33 at time instant t. The system model is given by x(t+1)=F x(t)+w(t), where $$F = \begin{matrix} [1 \Delta T] \\ [0\ T] \end{matrix}$$

is the (2×2) model matrix describing system evolution, ΔT represents the time between adjacent image frames, and where w(t) is a (2×1) matrix representing system perturbation to allow tracking of the marker band features. The matrix w(t) is assumed to be distributed as a zero-mean Gaussian noise process with (2×2) covariance matrix Q. The observation equation is given by b(t)=H x(t)+u(t), where b(t) is the height estimate generated by the band or feature 33 detector and location process at time instant t, H=[1 0] is the (1×2) vector, x(t) is the state vector as above, and u(t) represents the uncertainty associated with the marker band location algorithm. The value u(t) is assumed to be distributed as a zero-mean Gaussian process with variance R.

During initiation of a tracking process, the respective elements of the state vector are assigned the current band or feature 33 height and zero velocity, the diagonal elements of the system model covariance matrix Q are assigned to 0.01 representing a good model for the typically slowly evolving dynamics of band or feature 33, and the variance associated with observation equation R is set to a relatively large value of 10.0 following current practice to ensure convergence. The Kalman filter is implemented using standard prediction and update steps, the details of which are widely available in open literature.

The Kalman filter-derived estimates provide a superior representation to the observed band or feature 33 dynamics and show high noise immunity to unfiltered estimates. The Kalman filtering step, though not essential, proves particularly useful in cases where the intensity of the band or feature 33 is relatively faint (i.e., low SNR) as it represents a robust and deterministic method for dealing with noise and measurement uncertainty.

It should be appreciated that there may be many grey scale pixel intensity level peaks along the datum, each peak representing a different band or feature 33. Further, these peaks may have different peak pixel intensity values. These may all be processed to determine if they exceed the threshold, and all of these, or selected ones of these used for horizon control.

Figure 6:
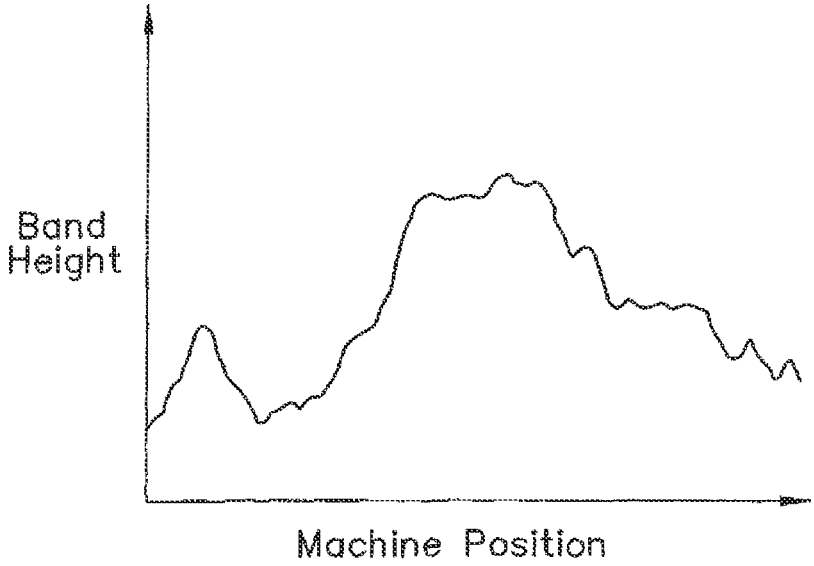
FIG. 6 is a graph showing the height of a thermal contrast region-V-mining machine position.

FIG. 6 shows a plot of the band or feature 33-V-mining machine 9 position. The actual noting of the height co-ordinate of the band or feature 33 is inherently a spatial quantity. It is convenient in a mining machine operation to refer the band or feature 33 height co-ordinate in terms of position instead of time. This is easily done by noting the values of the height of the band or feature 33 against the mining machine 9 position. FIG. 6 illustrates a typical output from a tracking algorithm (to be referred to later) showing the band or feature 33 height as a function of horizontal face position of the mining machine 9 across the width of seam 1.

Figure 7:
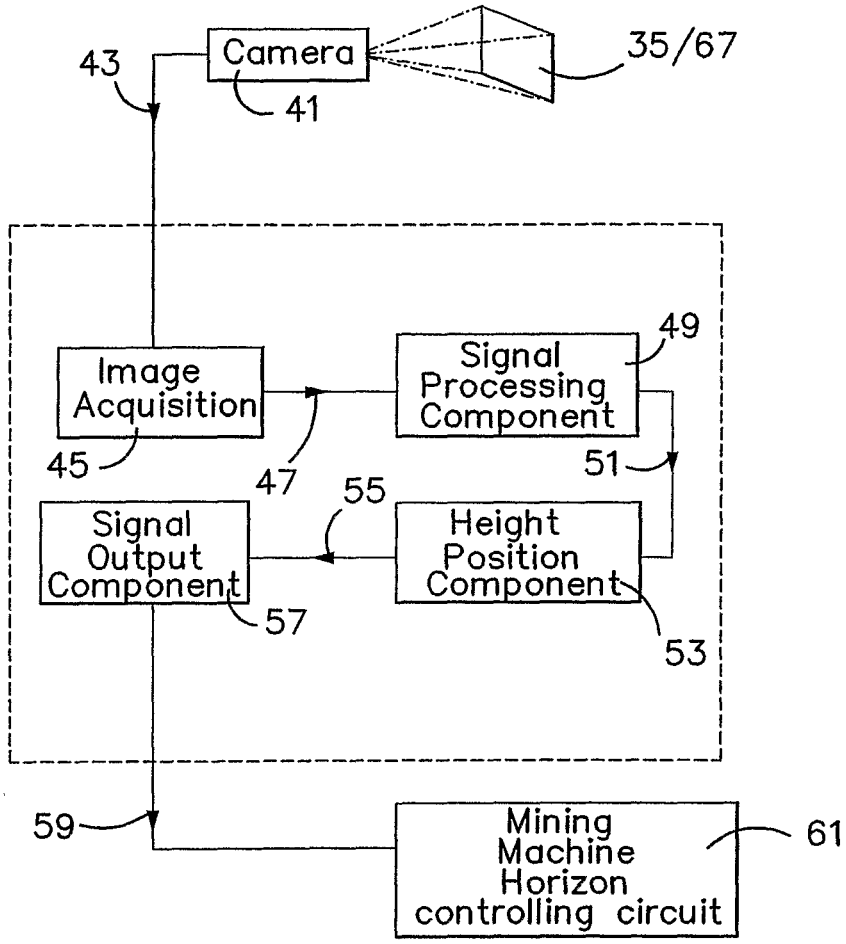
FIG. 7 is a functional block circuit schematic diagram showing apparatus for processing the IR contrast region picture image signals obtained from an IR camera visually observing the IR radiation from the fresh cut product face.

FIG. 7 is a block schematic diagram showing components of apparatus used for providing a signal output for mining machine horizon control. Here, the apparatus utilises the concepts hereinbefore described. A thermal IR digital video camera 41 observes the fresh cut product face 25 and has a field of view 34 encompassing a region of interest 35. Digital output signals 43 are supplied to an image acquisition component 45 for receiving the IR image signals of the fresh cut mined product face 25 immediately adjacent a mining machine cutter drum 11. Signals 47 are output from the image acquisition component 45 and supplied to a signal processing component 49 where the IR image signals in the region of interest 35 are noted for at least one temperature contrast region between an upper part of the image and a lower part of the image and between an upper limit of the seam and a lower limit of the seam. If at least one temperature contrast region is determined, then signals 51 are provided to a height position component 53 where a co-ordinate of the height position is calculated of the at least one noted temperature contrast region. Height position co-ordinate signals 55 are then provided to a signal output component 57 to provide an output signal 59 of the calculated height position of the at least one temperature contrast region so that that output signal 59 can be used in a mining machine horizon controlling circuit 61. The various components referred to in FIG. 7 can be discreet components or can be components within a computer device. Typically, the components are configured within a computer device using software dedicated for the purpose of configuring the computer to perform the functions required. Whilst the height position co-ordinate has been described as 1D, the co-ordinate may be 2D or 3D by appropriately inputting data signals of the absolute position of the mining machine 9 within the mine. Such signals can be obtained from inertial navigation components associated with the mining machine 9.

Figure 8:
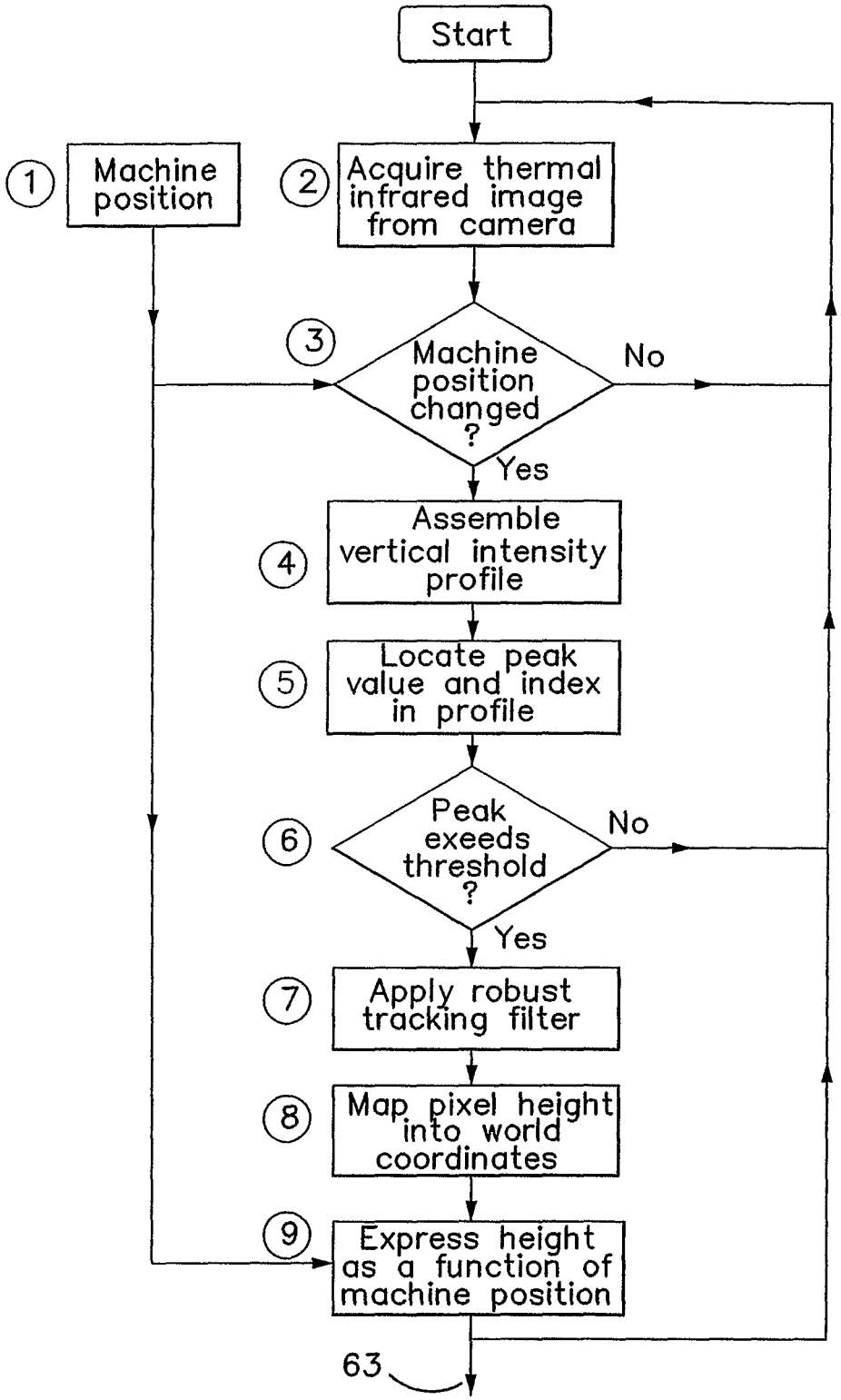
FIG. 8 is a processing algorithm utilised with the apparatus schematically shown in FIG. 7.

FIG. 8 shows an algorithm of the processes involved. Here, step 1 determines a mining machine position. A suitable position measurement apparatus is commonly provided on most large coal mining equipment such as longwall shearers or continuous miners. Thus, signals can be derived at step 1 representing the position of the mining machine 9. Independent known mining machine positioning means may be utilised to provide mining machine position signals if required. At step 2, the thermal infrared images are received using a direct-digital interface or by applying standard analogue to digital conversion techniques in the event the image is an analogue image. A typical thermal image is one shown by FIG. 4 herein. It should be noted that from the point of data acquisition, the output from a thermal IR video camera is analogous to a standard still image camera, that is, a sequence of still images in digital or analogue form. The algorithm shown in FIG. 8 processes each image frame sequentially, nominally regardless of acquisition rate. This frame selection is an arbitrary choice and is not meant to be limiting.

At step 3 machine position change sensing is determined. This is because unless the mining machine 9 has advanced across the face of the seam 3, there would be no need to reprocess an existing image acquired by the camera 41. Thus, signals from the machine positioning are compared to note if the machine 9 has moved and so that the image signals can be processed at step 4. In step 4, if a band or feature 33 is present, then it indicates a regional feature relative to the local background. Thus, a data set is formed by tracking the image pixel value at the datum position 37. This results in the generation of a data set similar to that shown in FIG. 5. At step 5, the localised peak 39 is determined by the intensity levels of the grey scale pixel values along the vertical datum line—up and down the height of viewing of the field of view 34 at the datum position 37. The brightest point in the pixel intensity values represents a localised peak 39. Step 6 determines if the peak 39 exceeds the set threshold represented by $d_{min}$ (FIG. 5). At step 7 a robust tracking filter such as the Kalman filter described previously is applied. At step 8, the height of the localised peak 39 (height "b" in FIG. 4) is determined. It may be desirable to express this height value in other co-ordinate systems such as mining machine co-ordinate positions. This can be achieved by direct application of camera calibration techniques knowing the position of the camera on the mining machine 9.

It should be noted herein that the description so far relates to detecting a single band or feature 33 in the field of view 34 region of interest 35. Multiple bands or features 33 may be detected and the algorithm suitably processed to enable relative tracking of two or more of the noted bands or features 33. Thus, one or more of the noted bands or features 33 may be used to control for mining machine horizon control. This is particularly useful where one or more bands or features 33 may disappear in the region of interest 35 whilst other bands or features may remain.

Figure 9:
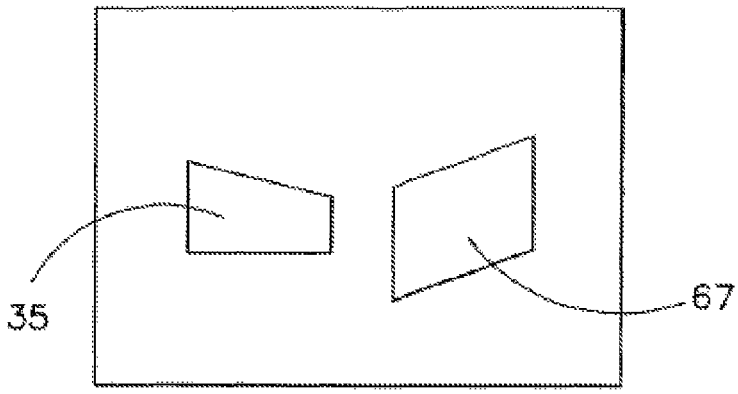
FIG. 9 is a view similar to that in FIG. 3 but showing a second IR observation of the freshly cut product face to determine an upper or lower limit of the seam.

At step 9 the height co-ordinates determined at step 8 are transformed as a function of machine position as represented by FIG. 6 herein. Thus, an output signal 63 can be provided to a mining machine 9 for horizon control. Referring now to FIG. 9 there is shown a view similar to that of FIG. 3 but also showing a IR image second region of interest 67. Here, the second region of interest 67 is arranged to encompass an intersection of the vertical fresh cut face 25 with the roof 17 or floor 19. The area and position of the second region of interest is defined by pixel locations in the image of the field of view 34. Thus, a second region of interest 67 supplies further IR image signals to note for any temperature contrast region at the intersection of the vertical cut face 25 (see FIG. 2) and either or both the horizontal cut face of the roof 17 or floor 19. Here, any noted IR temperature contrast region defines the intersection of the seam 1 with the upper strata 5 and/or the lower strata 7. Thus, height position signals can be generated of those further IR image signals from the fresh cut product face to be used with the signals of the band or features 33 previously described for horizon control. Thus, in this case, the further IR image signals can be processed to provide height positions of the intersection of the vertical cut face 25 with the roof 17 or floor 19 to limit the extent of upward and/or downward movement of the arm 13 to, in turn, control the upper limit of seam mining and lower limit of seam mining. In this case, a second output signal is provided indicating the determined height co-ordinate position of the temperature contrast region at the intersection.

Figure 10:
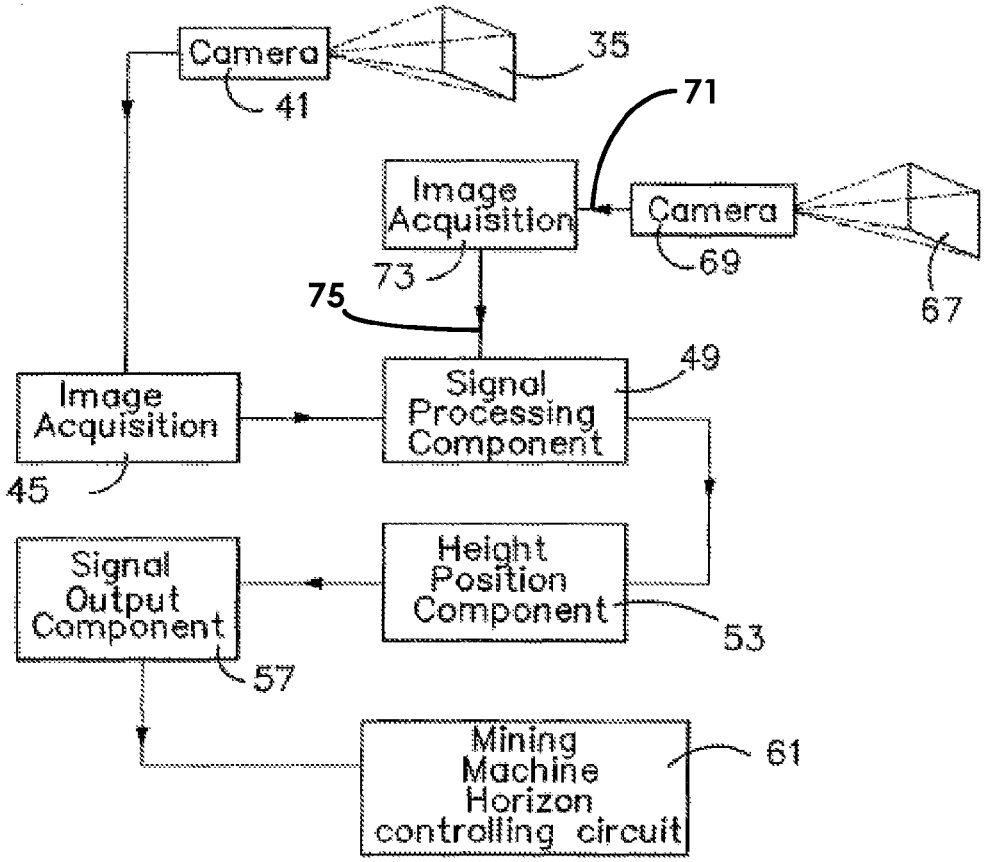
FIG. 10 is a block schematic diagram similar to that shown in FIG. 7 but showing the addition of components for processing upper and/or lower limits of the seam of the product.

FIG. 10 shows a block schematic diagram of an arrangement having the band or feature 33 sensing apparatus described previously, and apparatus for noting the intersection of the vertical cut face with the roof 17 or the floor 19. In this example one IR video camera 41 is used for region of interest 35 and a further IR video camera 69 is used for the second region of interest 67. In the preceding discussion a single IR camera 41 was utilised to encompass both regions of interest 35, 67. In this example the second IR video camera 69 has been utilised to show that the concepts need not be limited to a single IR camera implementation. The left hand side components of FIG. 10 repeat the components shown in FIG. 7 herein and will not be described further. On the right hand side of FIG. 10 there is shown a second thermal IR video camera 69 having a field of view 67. Digital output signals 71 are fed to an image acquisition component 73. Signals 75 are output from an image acquisition component 73 and provided to the signal processing component 49. Here the signals are fed to a height position component 53 where the height co-ordinate positions of the temperature contrast regions that define the intersection of the vertical cut face 25 of the seam with the roof 17 and/or floor 19 are calculated. Here, the signals are output to the signal output component to define co-ordinate position signals which are supplied to the mining machine control circuit 61 for controlling the mining machine.

Figure 11:
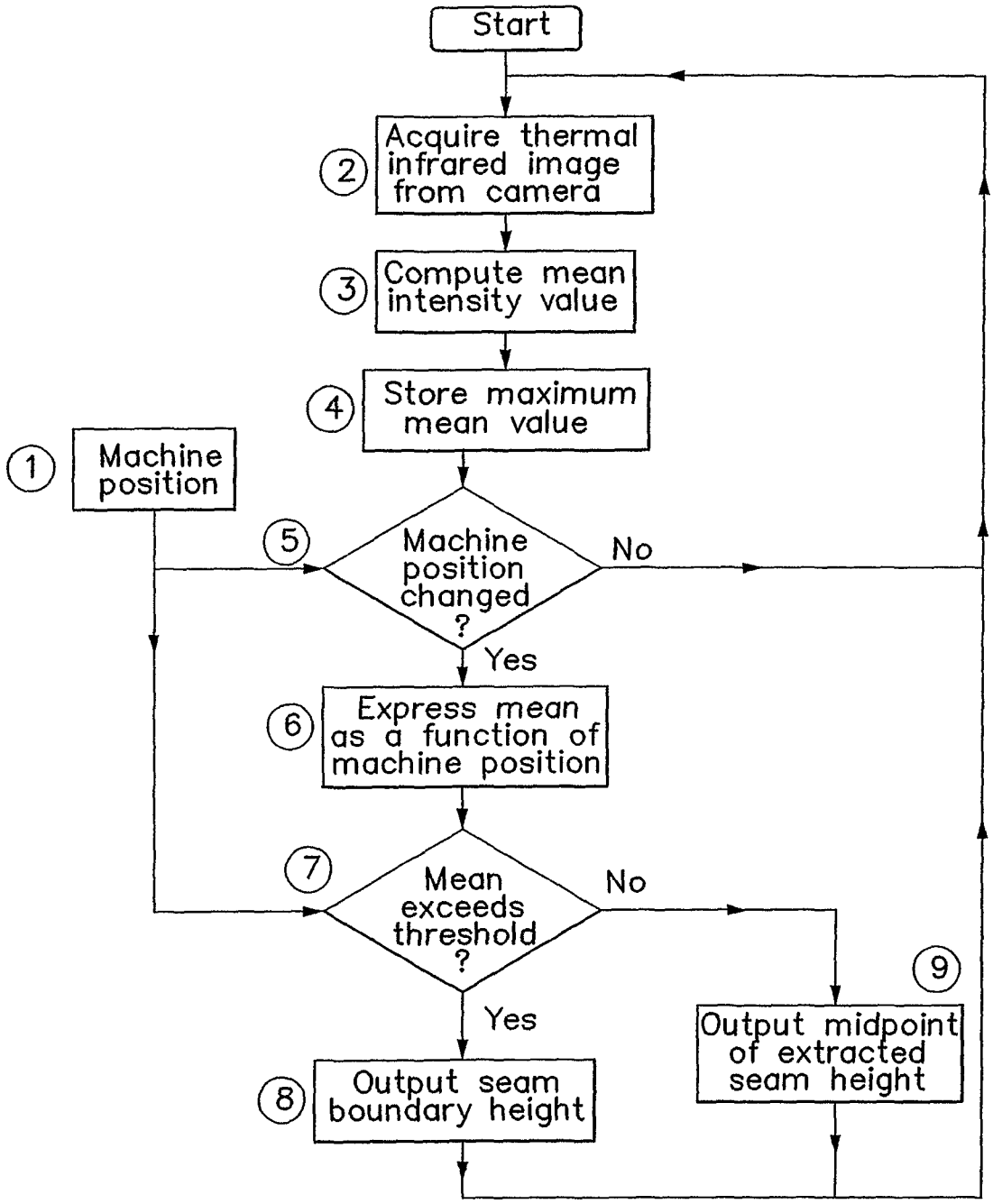
FIG. 11 is an algorithm for use with the apparatus shown in FIG. 10 in so far as determining the upper and or lower limits of the seam.

FIG. 11 shows a processing algorithm for detecting the fresh cut product face 25 intersection with the roof 17 or floor 19. This algorithm requires two parameters to be established during initial calibration. The first parameter corresponds to a threshold above which the coal seam interface with the roof 17 or floor 19 is assumed to have been reached. A detection threshold is set at 70% of the maximum intensity value and represents an appropriate initial choice. The second parameter is the seam extraction height which can be readily determined from the mining machine 9 itself using known processes.

At step 1 the machine position is ascertained according to the same processes described in relation to step 1 in FIG. 8. At step 2 image acquisition is performed and this again is identical to step 2 shown in FIG. 8 but from a different camera or region of interest within the image from a single camera. At step 3 a mean intensity value of all pixels in the image of the field of view is determined. If the mean intensity value changes, as noted by an averaging process of all the intensity value levels of the pixels in the image from the second camera 69, then it can be determined that there has been an intersection of the cutter drum 11 with the roof 17 or the floor 19. At step 4, a maximum mean pixel intensity value is stored. Such value may change significantly as the cutting drum 11 moves through segments of harder material (eg. rock) and provides a robust measure of any thermal intensity values. The maximum mean value is stored for the current machine 9 position.

At step 5 a process is invoked to determine if the machine horizontal position has changed. This is identical to step 4 in FIG. 8. At step 6, the magnitude of the mean intensity value computed at step 6 is compared to a pre-determined interface detection threshold. If the mean value is above the coal interface detecting threshold, then the coal seam interface is considered to be breached. Conversely if the mean value is below the coal interface then the mining machine is assumed to be cutting within the seam 1. At step 8 an output is provided of the seam interface positions of the interface with the roof 17 or the floor 19. This provides a maximum height for mining of the machine or a lower height for mining of the seam. In step 9, a mid point output signal is provided if no coal interface intersection is determined. This provides a suitable sentinel signal (eg. half the extracted seam height) to provide an output suitable for use in a horizon control system. Alternatively, a suitable sentinel signal can be established to run the mining machine control system in an open-loop mode.

The band or feature 33 tracking system described herein, and the coal interface detector for detecting the interface of the vertical fresh cut product face 25 with the roof 17 or the floor 19 provides two complimentary in-situ measures of the seam 1 behaviour. Whilst the outputs of the systems can be applied independently, they can also be usefully combined to provide a robust predictive-reactive sensing capability for use in real time horizon control of a mining machine 9.

Figure 12:
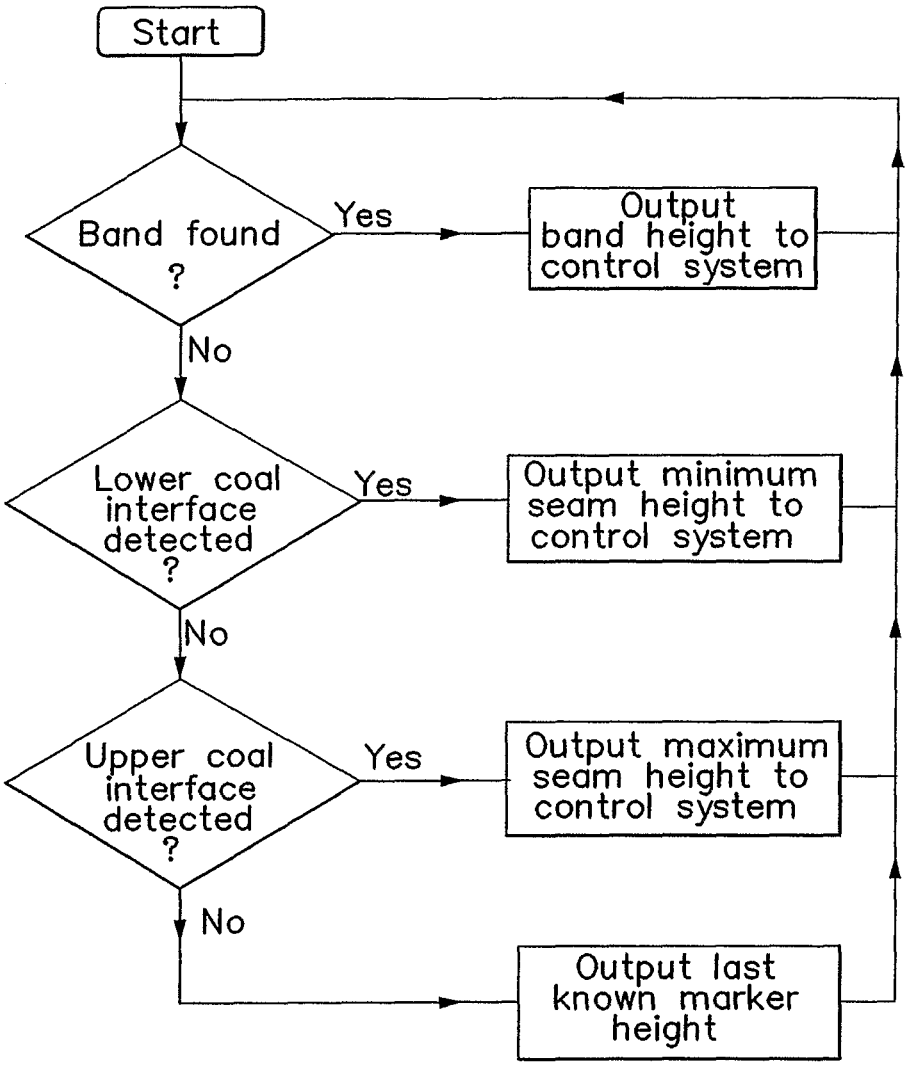
FIG. 12 is an algorithm showing outputs for use in horizon control of a mining machine.

FIG. 12 shows how the outputs of the band or feature 33 tracking and the interface detection systems can be combined to provide a robust datum for horizon control. Thus, if it should occur that a primary and preferred mode of operation using the band or feature 33 is not available, then an output selector can be operated to use the reactive (and coarser) coal seam boundary interface signals for horizon control. If the band or feature 33 tracking signals are provided and no interface intersection signals are provided, the system can output, depending on mine site's specific horizon control policy, the last band or feature 33 output signals, half seam extraction height signals or zero signals. Here, at step 1, a marker band assessment is made to determine if a band or feature 33 is present. If present, an output height signal is provided at step 2. If no band or feature 33 is determined, then at step 3 an assessment is made as to whether a floor coal interface is detected. If it is detected then an output signal is determined to indicate the height of the floor. If no floor interface is detected then an assessment is made at step 5 as to whether a roof intersection is detected. If it is detected then an output signal is provided to indicate the height of the roof 17. If no interface is detected then step 7 provides the last known band height output signals.

In order to achieve horizon control of a mining machine such as a longwall mining shearer, the output of the band or feature 33 tracking system is fed into an existing mining machine shearer arm 13 control system. The arms 13 are the principal method for adjusting the horizon (horizontal) position of the longwall shearer machine 9 as it extracts product 3 such as coal. Corrections to the mining horizon are usually applied on each backwards and forwards traverse cycle of the mining machine 9 along the rail means 15. The band or feature 33 height signals may be acted upon by the control system in an instantaneous manner using the observed heights. This is because any variation in the height is expected to be quite minimal. If required, the height locations at various positions along the face of the mine may be stored in memory and subsequently retrieved on a next backwards or forward traverse cycle of the mining machine 9 where they can be retrieved and compared with any newly measured height positions of the bands or features 33.

Account may be taken of the dynamics of the mining machine 9 control system noting the specific mechanical limitations of the cutter drum 11 and any desired horizon profile rate of change to provide a safe and practical control.

Figure 13:
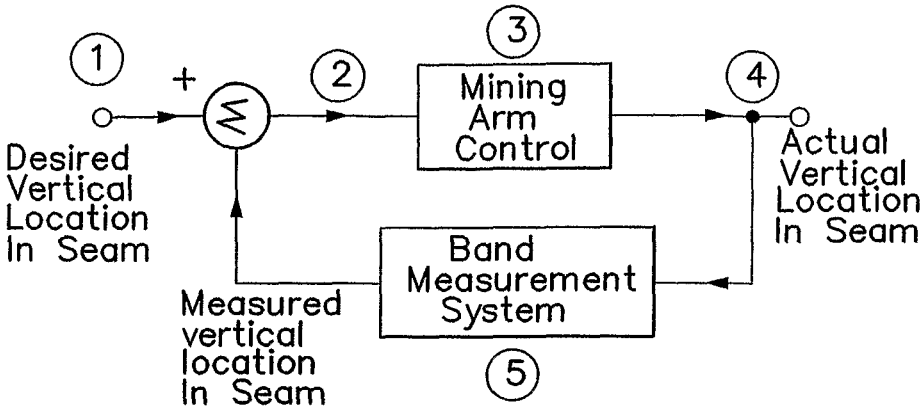
FIG. 13 is a functional diagram showing automated horizon control in a mining machine.

FIG. 13 is a block schematic diagram showing a general arrangement for the automation of the horizon control in a mining machine 9. A desired vertical location within the seam 1 is typically a fixed offset from the band or feature 33 height location. Here at step 1 a desired horizon set point is established. At step 2 a command (position error) signal is provided to the arm position control system at step 3. At step 4 an actual vertical location of the mining machine 9 is determined within the seam. At step 5, the combined band and feature 33 system and the interface detection system provide a vertical position sensing capability to provide for a control loop.

A system of the above type is useful in automated control systems for mining coal in a longwall mining and minimises equipment damage whilst increasing productivity and improving personnel safety. Using the methods herein no external reference infrastructure such as beacons, markers, stripes are required for operation. Thus, there is increased practicality and robustness of mining machines utilising the concepts herein. The principles herein can operate in either real-time or offline. The techniques disclosed herein represent automatic, online, self-regulating methods for roof or floor detection and band or feature 33 detection for horizontal control. Further, the co-ordinate position output signals of the band or feature 33 positions or the interface positions of the roof 17 or floor 19 can be used in mining survey processes to greatly enhance mining operations.

Figure 14:
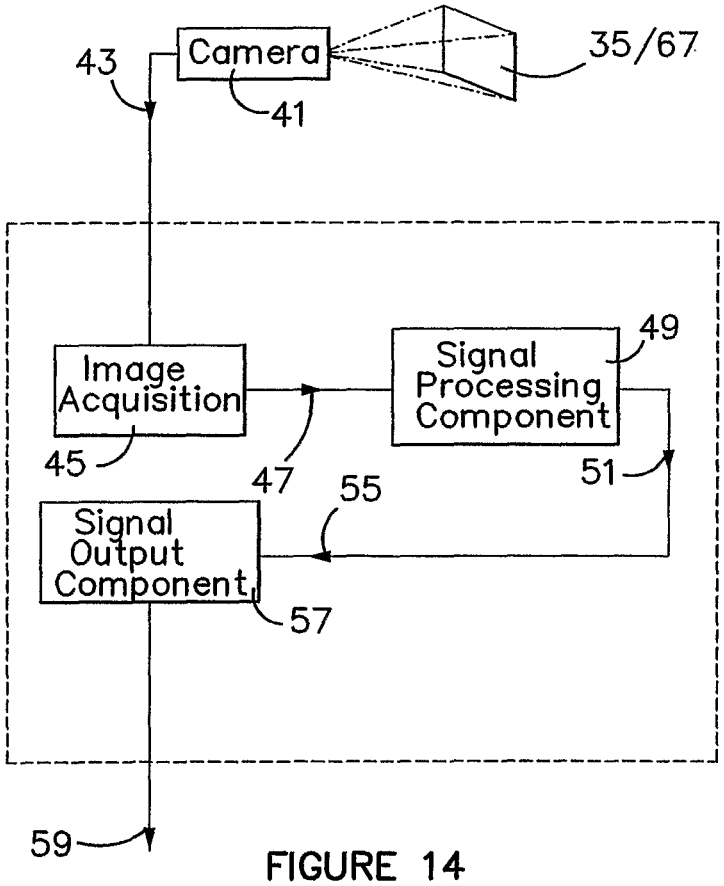
FIG. 14 is a further functional block circuit schematic diagram showing apparatus for processing the IR contrast region picture image signals obtained from an IR camera visually observing the IR radiation from the fresh cut product face.

It should also be appreciated that the band or feature 33 system described herein can be utilised for identifying thermally identifiable structure in a mined product when mining that product from a mine. Thus, by noting the IR image signals of an observed position of a freshly exposed cut product face immediately adjacent the mining machine cutter, one can obtain signals which can be useable to identify thermally identifiable structure in the mined product. The thermally identifiable structure can be identified by either noting the size magnitude (i.e. the number of high intensity pixel) of the at least one temperature contrast region, or noting the magnitude of the at least one temperature contrast region above a temperature threshold. An output signal can be provided from an output component to indicate thermally identifiable structure in the mined product. In this example, FIG. 7 shows the necessary signal processing components where the output signal 59 provides an indication of the thermally identifiable product. A specific circuit diagram is shown in FIG. 14. Here, the digital video camera 41 will provide output signals 43 to the image acquisition component 45. The image acquisition component 45 will process the signals 43 in the same way as explained in relation to the FIG. 7. Output signals 47 will be provided to the signal processing component 49 which can sense if the IR temperature pixel intensity values exceed a particular threshold, and provide an output signal 51 to the signal output component 57 which will, in turn, provide an output signal 59 indicating the presence or absence of thermally identifiable structure in the mined product. Thus, in this embodiment, the signal processing component 49 can note either the size magnitude of the at least one temperature contrast region, or if the temperature contrast region has a magnitude above a temperature threshold.

Modifications may be made to the invention as would be apparent to persons skilled in the mining machine control arts. These and other modifications may be made without departing from the ambit of the invention the nature of which is to be determined from the foregoing description.

The invention claimed is:

1. A method of horizon control in a mining operation where mined product is cut from a mining face of a seam of the product, said method comprising:

observing, with an infrared (IR) camera, infrared radiation from a freshly cut mining face, the observed infrared radiation generated in response to cutting the mining face and without irradiating the mining face with infrared radiation;

determining, from the observed IR radiation, at least one temperature contrast region between upper and lower extents of the freshly cut mining face, the at least one temperature contrast region corresponding to a band of material located in the freshly cut mining face between upper and lower extents of the freshly cut mining face;

determining at least one height co-ordinate position of the at least one determined temperature contrast region of the freshly cut mining face;

generating an output signal corresponding to the determined height co-ordinate position; and using the generated output signal for horizon control in a mining operation.

2. The method as claimed in claim 1 wherein the step of observing infrared radiation comprises providing a field of view of the IR radiation with a datum position in a horizontal axis direction that extends in a vertical axis direction relative to a region of interest for the IR radiation, and wherein the at least one temperature contrast region from the IR observation is determined at the datum position.

3. The method as claimed in claim 1 further comprising cutting the product from the seam with a cutter that exposes the freshly cut mining face.

4. The method as claimed in claim 3 further comprising observing the infrared (IR) radiation from the freshly cut mining face at a position immediately adjacent the cutter.

5. The method as claimed in claim 4 wherein the position immediately adjacent the cutter comprises a position in a vicinity of the cutter where it is possible to determine temperature contrast regions from the observed IR radiation.

6. The method as claimed in claim 5 further comprising:

defining a threshold IR radiation value above a background IR radiation level of the freshly cut mining face;

noting observed IR radiation that exceeds the threshold IR radiation value; and determining a temperature contrast region in response to observed IR radiation exceeding the threshold IR radiation level.

7. The method as claimed in claim 6 wherein the position is defined by a distance from the cutter, and wherein the observed IR radiation has not dissipated with time following cutting by the cutter and said observed IR radiation exceeding the threshold IR radiation is detectable.

8. The method as claimed in claim 6 wherein noting observed IR radiation that exceeds the threshold IR radiation comprises using a threshold filter.

9. The method as claimed in claim 3 further comprising observing the infrared (IR) radiation with a camera mounted on a body of a mining machine so that the camera is protected from operation of the cutter.

10. The method as claimed in claim 1 further comprising noting any temperature contrast regions from the observed IR radiation between an upper limit of observation and a lower limit of observation.

11. A sensing apparatus for operating with mining machine horizon controlling apparatus, comprising:

an infrared (IR) camera arranged to observe infrared radiation generated in response to cutting the mining face and without irradiating the mining face with infrared radiation;

an image acquisition section configured to receive IR image signals indicative of an observed position of a freshly cut mining face from the IR camera;

a signal processing component configured to process the acquired IR image signals to identify at least one temperature contrast region, between upper and lower extents of the freshly cut mining face, the at least one temperature contrast region corresponding to a band of material located in the freshly cut mining face between upper and lower extents of the freshly cut mining face;

a height position component configured to calculate a height co-ordinate position of the at least one temperature contrast region; and a signal output component configured to provide an output signal corresponding to the calculated height co-ordinate position for said mining machine horizon controlling apparatus.

12. The sensing apparatus as claimed in claim 11 wherein the freshly cut mining face is exposed by a cutter of a mining machine.

13. The sensing apparatus as claimed in claim 12 wherein the observed position of the freshly cut mining face is at a position immediately adjacent the cutter.

14. The sensing apparatus as claimed in claim 13 wherein the position immediately adjacent the cutter is in a vicinity of a cutter of a mining machine that exposes the freshly cut mining face where it is possible to determine at least one temperature contrast region from the observed IR radiation.

15. The sensing apparatus as claimed in claim 14 wherein the position immediately adjacent the cutter corresponds to a distance from the cutter from which observed IR radiation exceeding a threshold IR radiation value is detectable, the threshold IR radiation value being above a background IR radiation value of the freshly cut mining face, and the at least one temperature contrast region being determined in response to observed IR radiation exceeding the threshold IR radiation value.

16. The sensing apparatus as claimed in claim 15 wherein the distance from the cutter comprises a distance where the observed IR radiation has not dissipated with time following cutting by the cutter so that said observed IR radiation exceeding the threshold IR radiation value can be noted.

17. The sensing apparatus claimed in claim 15 comprising a threshold filter arranged to note observed IR radiation that exceeds the threshold IR radiation using a threshold filer.

18. The sensing apparatus as claimed in claim 14 wherein the signal processing component is further configured to note for the at least one temperature contrast region between an upper part of an image and a lower part of the image captured by the camera, to provide at least one noted temperature contrast region.

19. The sensing apparatus as claimed in claim 18 wherein the height position component is further configured to receive at least one noted temperature contrast region and to calculate the height co-ordinate position of said at least one noted temperature contrast region.

20. The sensing apparatus as claimed in claim 12 wherein the image acquisition section is further configured to receive said IR signals from a camera mounted at a position on a body of the mining machine so that the camera is protected from operation of the cutter.

21. A method of horizon control in a mining operation where mined product is cut from a mining face of a seam of the product, said method comprising:

observing, with an infrared (IR) camera, infrared radiation from a freshly cut mining face, the observed infrared radiation generated in response to cutting the mining face and without irradiating the mining face with infrared radiation;

determining, from the observed IR radiation, at least one temperature contrast region between upper and lower extents of the freshly cut mining face;

determining at least one height co-ordinate position of the at least one determined temperature contrast region of the freshly cut mining face;

generating an output signal corresponding to the determined height co-ordinate position; and using the generated output signal for horizon control in a mining operation.

* * * * *